United States Patent [19]

Cook

[11] Patent Number: 4,488,720

[45] Date of Patent: Dec. 18, 1984

[54] FOLDABLE GAME BOARD WITH ROTATABLE DISPLAY DISK

[76] Inventor: Eugene F. Cook, 5858 Mt. Alifan Dr., San Diego, Calif. 92111

[21] Appl. No.: 448,317

[22] Filed: Dec. 9, 1982

[51] Int. Cl.[3] ..... A63F 3/00

[52] U.S. Cl. ..... 273/239; 273/280; 273/285; 273/278

[58] Field of Search ..... 273/239, 280, 281, 285, 273/287, 113, 278, 272; 40/433, 435, 434, 377, 378, 379

[56] References Cited

U.S. PATENT DOCUMENTS

| | | | |
|---|---|---|---|
| 343,496 | 6/1886 | Seliger | 273/285 X |
| 606,030 | 6/1898 | Rowell | 273/113 |
| 2,284,242 | 5/1942 | Ziemmerman | 273/285 |
| 3,195,896 | 7/1965 | Markham | 273/280 X |
| 4,002,342 | 1/1977 | Biggs | 273/256 X |

FOREIGN PATENT DOCUMENTS

| | | | |
|---|---|---|---|
| 810858 | 6/1951 | Fed. Rep. of Germany | 273/280 |

*Primary Examiner*—Richard C. Pinkham
*Assistant Examiner*—Matthew L. Schneider
*Attorney, Agent, or Firm*—Brown, Martin & Haller

[57] ABSTRACT

The game board features a display disk situated between upper and lower layers. The display disk has a plurality of radial columns of information which are rotated under display windows in the upper layer. A removable drive hub engages the disk through a central recess in the upper layer. Channel sectors in the lower layer limit the rotation of the hub and disk. The upper and lower layers each consist of two sections hingedly joined together. Folding of the game board is accomplished by aligning the fold line on the disk with the hinge line between the two game board sections.

6 Claims, 6 Drawing Figures

FOLDABLE GAME BOARD WITH ROTATABLE DISPLAY DISK

BACKGROUND OF THE INVENTION

Board games, sometimes known as parlor games, enjoy a wide popularity because they can be used on virtually any subject of interest to a substantial number of players and are highly portable. That is, the market for board games is largely to persons who require that the board games be conveniently transportable and easily stored. The games are frequently played by persons not in the same household or away from the home and it is, therefore, important to be able to transport the game easily to a different location, set up the game at that location, and later disassemble the game into a compact package for further transportation and subsequent storage.

For many years the requirement of compactness has imposed a substantial limitation on the ability to market particular games. An example of the type of game that is difficult to market because of the portability-compactness requirement is the game set forth in U.S. Pat. No. 4,002,342. This patented game is representative of a genre of games which must display a large amount of information in a format where significant parameters of the information can be changed by the player. As presented in the patent, the information is displayed in plurality of radial columns on an upper rotatable surface which moves over a field of numbers that can be viewed through selected display windows. Since the upper surface is rotatable, there is no convenient way that the rotatable surface can be made foldable and, thus, the size of the game, and therefore the amount of information that can be presented, is limited. Also, since the upper surface of the board is manipulated to change the numbers appearing through the display windows, the problem of the game pieces becoming dislodged during movement of the board is compounded. The patented game incorporates magnetized media underneath the game surface so that the ferrous game pieces will be held securely in place during the movement of the board. Magnetic materials in sheet form, and of sufficient size to underlie the entire board, are relatively expensive, again limiting the size of the board and the potential market for the game.

Accordingly, it is desirable to have a game board with a rotatable element for varying the game parameters displayed to the players which, at the same time, is foldable for portability and storage. Such a game is particularly desirable where low cost provision is made for preventing the game pieces becoming dislodged during operation of the variable information display.

SUMMARY OF THE INVENTION

In an exemplary embodiment of the invention, the disadvantages of prior art games are overcome in a board which utilizes a rotatable disk of sheet material received between foldable layers of the generally circular game board. The disk incorporates a fold line of reinforced material. Folding of the board is accomplished by first aligning the disk with the edges of two game board sections and then hingedly folding the sections one on top of the other. The upper surface of the board need not rotate. Thin sheets of ferrous material may be located immediately below the surface of the board so that relatively inexpensive magnetic game pieces can achieve a secure magnetic attachment by their close proximity to the ferrous material.

The hinged relationship between the game sections can be achieved through a matched pair of tape strips which are received along the mating edges of each of the sections and then are secured onto the under-surface of the two sections. The strips are positioned near the outer ends of the mating edges to leave the central portion open for the insertion and removal of the rotatable disk.

While not essential to the practice of the invention, it is advantageous to drive the disk in rotation from the center of the disk, and thereby to allow the periphery of the disk to be completely enclosed between the upper and lower layers of the board sections. Since the disk is driven in rotation, it is advantageous for the disk to be circular in configuration because it permits a maximum useful board area in a minimal collapsed size. For the purposes of driving the disk, the upper layer of the board is relieved to expose the disk in the central area surrounding the common axis of the disk and board. Maximum simplicity of the overall configuration is obtained by a circular opening in the upper surface of the board which accommodates a circular planform drive hub.

At least one engagement lug between the drive hub and disk is required and two are preferred. The lugs are conveniently secured on the drive hub, although equivalent hubs protruding from the disk are possible. In the exemplary configuration, a pair of diametrically opposed and radially offset drive lugs protrude from the lower surface of the drive hub and extend complimentary openings in the disk so that rotation of the hub causes rotation of disk. This configuration, without more, would provide a fully functioning, game-playing configuration with the disk free to rotate throughout a 360 degree freedom of movement. However, where a multi-sectored game board is required, false display information could be rotated from one display sector to an adjoining display sector. Therefore, a further advantageous feature of the invention is to provide for limiting rotation so that information from a particular sector is displayed only within the intended sector. Accordingly, drive lugs are provided that protrude through the disk and into a pair of elongated part-circular channels comprising channel sectors in the lower portion of the board. The circumferential extent of the channel sectors corresponds to the desired circumferential extent of display sectors. Thus, when the drive lugs are moved through the full freedom of movement from one end of the channels to the other, the display information for the desired display sector is rotated only through that range of movement which limits the display of information to the intended display sector.

Accordingly, there is provided a new and improved game board more fully set forth in the appended detailed description, together with the drawings in which like numbers refer to like parts throughout, and in which:

DETAILED DESCRIPTION OF THE DRAWINGS

Figure 1:
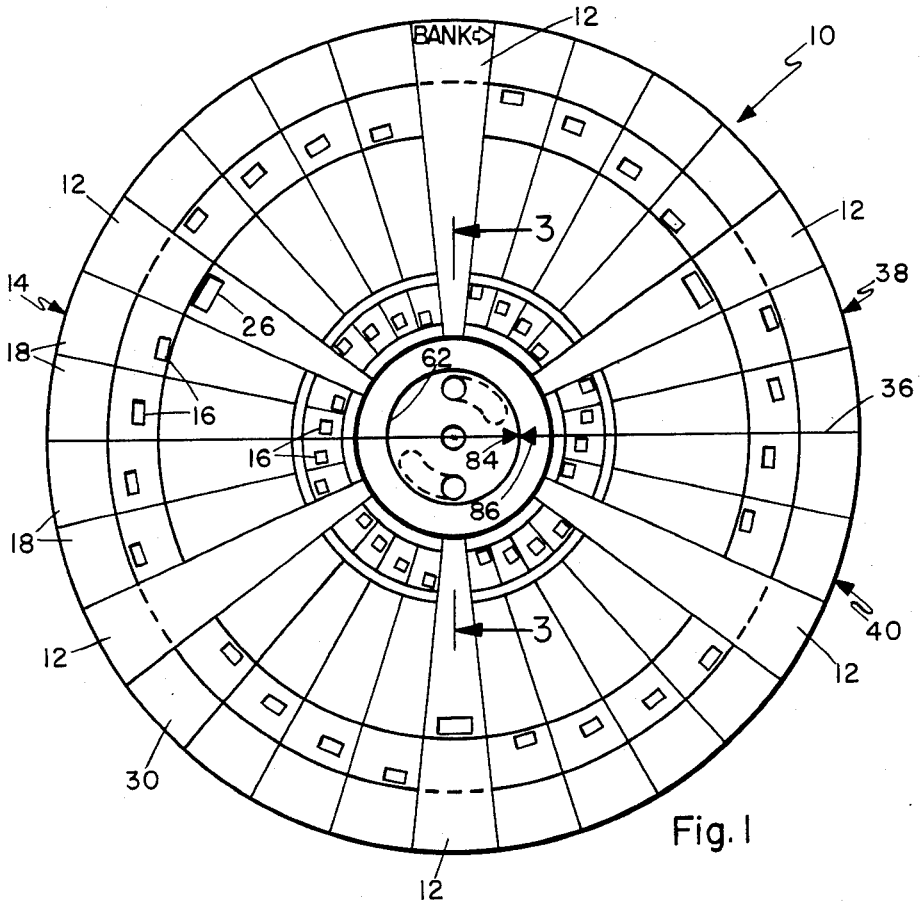
FIG. 1 is a top plan view of the game board.

Referring now to the drawings, and particularly to FIG. 1 thereof, there is illustrated a game board 10. The game board incorporates indicia dividing the game board into a series of radial columns. Full length radial columns 12 divide the game board into six display sectors of which the display sector 14 is typical. Within the display sector 14 a plurality of windows 16 are positioned to display information in the manner to be described hereinafter.

Figure 4:
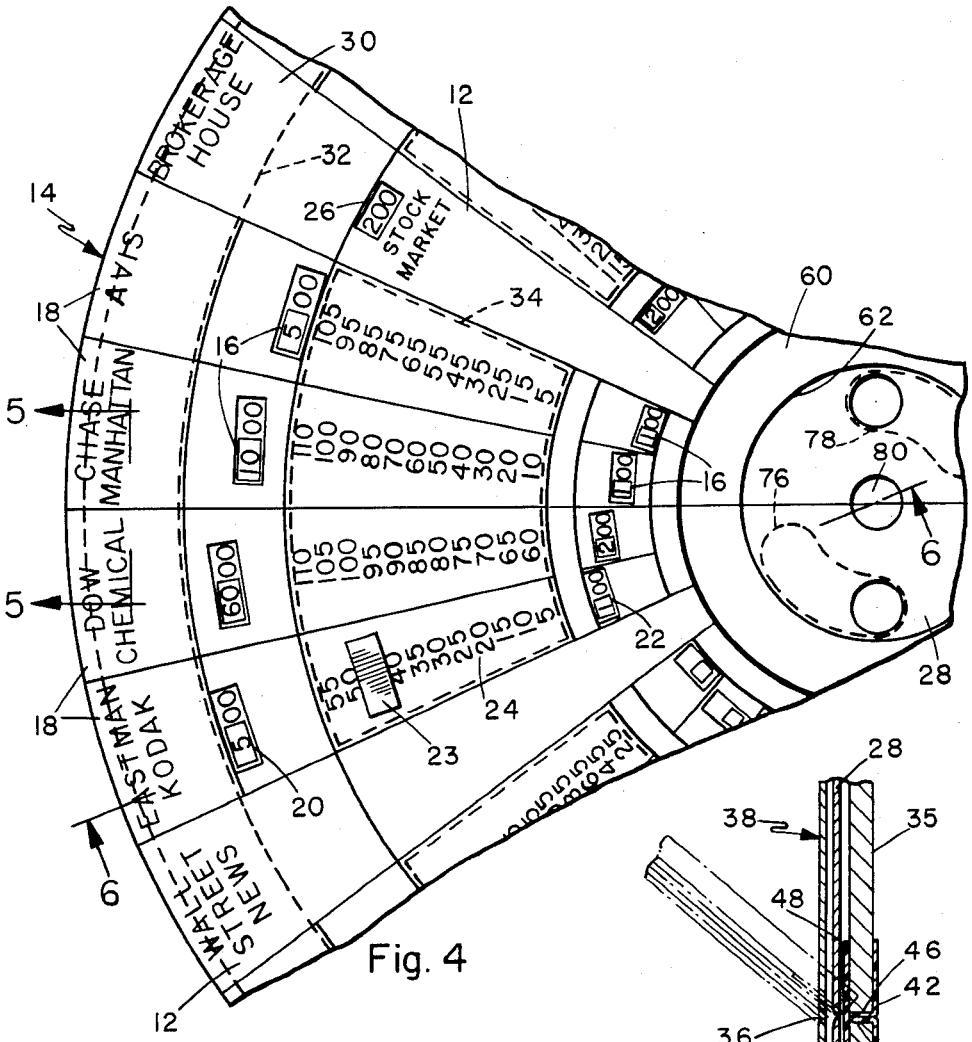
FIG. 4 is an enlarged top plan view of a portion of the game board.

Referring to FIG. 4, the details of the sector 14 are illustrated. The full length columns 12, and the sector columns 18 incorporate indicia, in this case to support the playing of a stock market game. The windows 16 are radially displaced so as to present distinct information consisting of one or more digits. For example, the window for the sector column labelled Eastman Kodak can vary the first two digits of a four digit number simulating the number of shares sold during a trading day, and within the column the window 22 can effect the first digit of a three digit number which, combined with the position of the game piece in the number field 24, produces a price per share of a selected stock. In the column 12 labeled Brokerage House, a window 26 displays a three or four digit number which corresponds to the Dow Jones Industrial Average.

Figure 6:
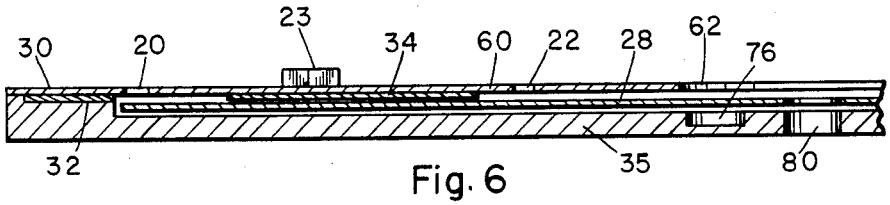
FIG. 6 is a sectional view taken on Line 6—6 of FIG. 4.

Referring to FIG. 6, the display disk 28 is shown positioned so as to display information through the various windows on the surface of the game board. Thus, the range of numbers to appear through the window 20 are printed in concentric alignment on the disk 28 at the radial position corresponding to the window 20. The range of numbers to appear through the window 22 are printed in concentric alignment on disk 28 to be positioned for viewing through the window 22.

As will appear from both FIGS. 4 and 6, provision is made for adhering the game pieces 23 along the portions of the board that the game pieces are moved and positioned, particularly the outermost concentric position corresponding in the illustrated game to the selection of a stock in the concentric track 30 and in the stock price section of the individual stocks as is exemplified by the radial column 24. In each of these areas, as will appear from the dotted outline in FIG. 4, ferrous material such as steel sheets 32 and 34 are positioned in the area where game pieces 23 must be adhered. The sheets are secured immediately below the upper surface of the game board.

The lower layer of the game board is shown to be a relatively thick layer 35 which provides a major proportion of the strength and rigidity to the game board.

Figure 5:
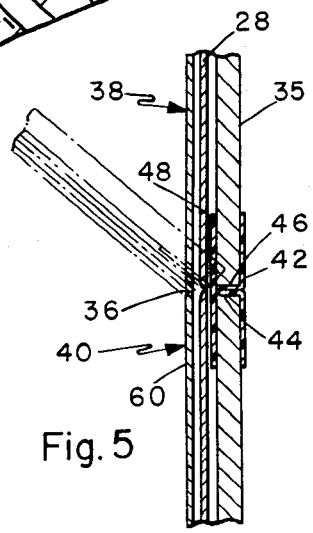
FIG. 5 is a sectional view taken on Line 5—5 of FIG. 4.

Referring to FIG. 5 in conjunction with FIG. 1, the manner in which the game board is hinged is illustrated. A hinge line 36 divides the game board into sections 38 and 40. The game board is folded with the upper surfaces of the sections 38 and 40 in contact. Hinging is provided by tape hinges, such as the exemplary tape hinge 42. The tape hinges are positioned at the outer radial ends of the mating edges between the sections 38 and 40. The tape hinge is adhered to the mating edges 44 and 46 with one terminal end of the tape being received on the under-surface of section 38 and the other on the under-surface of the opposed section 40. A reinforcement tape 48 extends across the inner surface of the mating edges of the sections comprising the lower layer 34, and increases the strength with which the sections of the lower layer are held in association.

Figure 2:
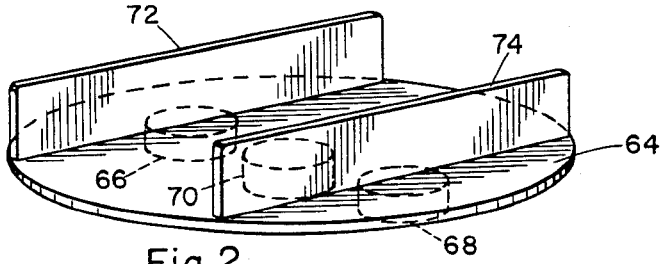
FIG. 2 is a perspective view of the rotator and card holder.
Figure 3:
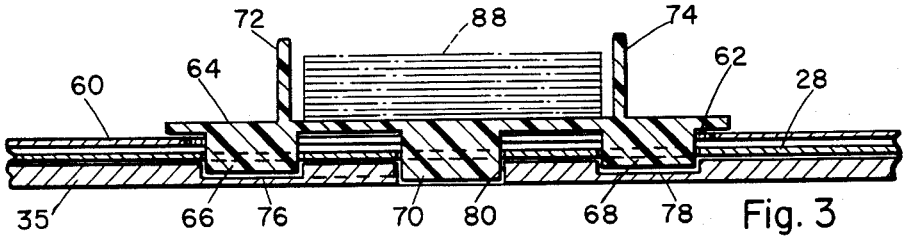
FIG. 3 is an enlarged sectional view taken on Line 3—3 of FIG. 1 with the rotator in place, the view being rotated 90 degrees.

Referring to FIG. 3, the structure by which the disk 28 is driven into rotation is illustrated. The upper surface of the game board 60 is penetrated by a circular opening 62 through which is received a drive hub 64 (see FIG. 2). The drive hub incorporates a plurality of drive lugs 66 and 68, together with a centering lug 70. Openings are provided through the disk 28 corresponding to the drive lugs 66 and 68 and centering lug 70 so that the lugs may protrude through the disk. The drive lugs are received with sector channels 76 and 78 (illustrated in FIGS. 1 and 4) and, thus, the drive hub is free to move only through the limited range of movement permitted by the sector channels. In the illustrated embodiment, the sector channel corresponds in the circumferential extent to that of the display sectors and, therefore, the numbers which can be rotated and viewed through the windows on the display sectors are limited to those numbers on the disk intended to be viewed through the selected windows. The centering hub 70 is received in an opening 80 through the lower layer 34 which absorbs the forces transmitted in rotating the drive hub to protect the upper layers of the board.

Upraised ridges 72 and 74 may be utilized to grasp the drive hub and rotate the drive hub. In addition to serving as handles, the ridges 72 and 74 can be used as a card holder for cards 88 utilized in the play of the game.

Referring again to FIG. 1, it will be noted that indicia 84 on the disk is visible through the opening 62 and may be brought by rotation through the drive hub into alignment with indicia 86 on the upper surface 60. When the indicia 84, 86 are in alignment, the fold lines of the disk 28 and board sections 38 and 40 are in alignment and, thus, the board may be collapsed without damage.

Having described my invention, I now claim:

1. A game board comprising:

first and second game board sections, said first and second sections being hingedly joined along mating edges, each of said sections comprising a plurality of layers, said layers being comprised of at least one upper layer and one lower layer, a display disk received between said layers for rotation with respect to said first and second sections, said display disk comprising generally planar sheet material and having a medial fold line, means for applying rotational force to said display disk to cause said display disk to move through a rotational arc, said rotational arc including at least one position in which said fold line of said disk is aligned with said mating edges of said first and second sections, said display disk incorporating a series of game information displays spaced from a central axis, said upper layer of each of said first and second sections incorporating thereon at least one viewing window for alignment with said game information displays at a selected rotational position of said disk.

2. The game board according to claim 1 wherein:

the upper layer incorporates a game piece playing area, one of said plurality of layers comprises ferrous material for underlying at least part of said game piece playing area, a plurality of magnetic game pieces for being received on said playing area.

3. The game board according to claim 1 wherein:

said layers of said sections above the level of said disk are penetrated by a central circular recess, said disk having engagement means by which said disk may be engaged and rotated.

4. The game board according to claim 3 wherein:

said game further comprises a removable drive hub means for engaging said disk said drive hub means having an upper and lower surface, said upper surface having a handle thereon and said lower surface having at least one drive lug extending therefrom.

5. The game board according to claim 4 wherein:

said handle comprises spaced generally parallel ridges.

6. The game board according to claim 4 wherein:

said lower layer incorporates a rotation limiting means comprising an elongated part-circular channel, said engagement means on said disk comprising an engagement opening through said disk positioned to receive said drive lug, said drive lug being sized for extending through said engagement opening and into said channel in said lower layer.

* * * * *